US005342574A

United States Patent [19]

Kasai et al.

[11] Patent Number: 5,342,574

[45] Date of Patent: Aug. 30, 1994

[54] METHOD FOR PRODUCING ANISOTROPIC RARE EARTH MAGNET

[75] Inventors: Yasuaki Kasai, Nagoya; Hiyoshi Yamada, Iwakura; Norio Yoshikawa, Nagoya, all of Japan

[73] Assignee: Daido Tokushuko Kabushiki Kaisha, Nagoya, Japan

[21] Appl. No.: 42,772

[22] Filed: Apr. 6, 1993

[30] Foreign Application Priority Data

Apr. 9, 1992 [JP] Japan ..... 4-116812

[51] Int. Cl.[5] ..... B22F 5/00

[52] U.S. Cl. ..... 419/61; 419/12; 419/65; 419/67; 420/83; 148/101

[58] Field of Search ..... 75/244, 246; 148/101, 148/103, 105, 302, 313; 419/12, 61, 65, 67; 420/83; 29/DIG. 31, DIG. 43, DIG. 47, 898.045

[56] References Cited

U.S. PATENT DOCUMENTS

| | | | |
|---|---|---|---|
| 4,325,757 | 4/1982 | Jandeska, Jr. et al. | 148/103 |
| 4,963,320 | 10/1990 | Saito et al. | 419/12 |
| 5,004,580 | 4/1991 | Matsuo et al. | 419/65 |
| 5,039,292 | 8/1991 | Tanigawa et al. | 425/75 |
| 5,084,115 | 1/1992 | Hadjipanayis et al. | 148/313 |
| 5,122,319 | 6/1992 | Watanabe et al. | 264/109 |

*Primary Examiner*—Donald P. Walsh
*Assistant Examiner*—John N. Greaves
*Attorney, Agent, or Firm*—Sughrue, Mion, Zinn, Macpeak & Seas

[57] ABSTRACT

A method for producing an anisotropic rare earth magnet is improved by extruding using a compacted material formed in a shape having difference in level between the center part to be in contact with the end face of a punch and the outer peripheral part to be faced with a molding cavity formed between the punch and a cylindrical die of a mold.

4 Claims, 3 Drawing Sheets

METHOD FOR PRODUCING ANISOTROPIC RARE EARTH MAGNET

BACKGROUND OF THE INVENTION

1. Field of the Invention

This invention relates to a method for producing an anisotropic rare earth magnet, and in particular to a method for extruding a compacted material in order to obtain a better yield of the anisotropic rare earth magnet excellent in magnetic properties.

2. Description of the Prior Art

Rare earth magnets represented by R-Fe-B (R is shown on behalf rare earth metals of lanthanum series) are provided in two types as mentioned hereunder;

(a) a sintered magnet which is made into an anisotropic magnet through a process of casting the molton base alloy into an ingot, pulverizing the ingot into super fine powder, pressing the powder in a magnetic field and sintering it, and (b) a super-quenched magnet which is given with magnetic anisotropy through a process of making a thin flake by cooling the molton base alloy super-rapidly, molding a compacted material with magnetic isotropy by compressing coarse grained powder of the thin flake of the base alloy and deforming the compacted material plastically.

The anisotropic rare earth magnets obtained through the aforementioned processes have excellent magnetic properties, therefore it is very useful to apply these magnets to small-sized electric motors used for various automatizing apparatuses in order to make the motors lighter and smaller.

Although it is desirable to make the magnet in a ring shape given with magnetic anisotropy in the radial direction in order to apply the anisotropy rare earth magnets to the motors, there is a problem since it is difficult to give a magnet field in the radial direction at the time of molding the powder in a magnetic field in the case of the aforementioned sintered magnet.

In the case of the super-quenched magnet, it is possible to give the magnetic anisotropy in the utmost limit even for the ring-shaped magnet because the magnetic anisotropy is given by the plastic deformation without forming in the magnetic field.

As a method for giving the magnetic anisotropy by the plastic deformation, heretofore, it is taken to extrude the compact material with magnetic isotropy formed in a hollow or solid circular plate-like shape, as disclosed in U.S. Pat. No. 4,963,320, for example.

An example of the extruding is shown in FIG. 4. In the figure, numeral 100 is a cylindrical die formed in a thick-walled cylindrical shape, numeral 102 is a bottom die forming a bottom part of a mold.

Numeral 104 is a core punch and numeral 106 is a sleeve punch disposed movably in a molding cavity 108 formed between the core punch 104 and the cylindrical die 100. The mold is constructed from the cylindrical die 100, the bottom die 102, the core punch 104 and the sleeve punch 106.

The bottom die 102 is provided with a hollow part 112 to receive a slender part 110 of the core punch 104.

In this method for giving anisotropy, a hollow circular plate-like (ring) shaped compacted material 114 is charged into the cylindrical die 100 of the mold, subsequently the compacted material 114 is extruded backwardly by pressing the core punch 104 into the compacted material 114 at the same time of compressing a free surface of the compacted material 114 fronting on the molding cavity 108 with the sleeve punch 106 moving back according as the progress of the extruding, thereby making the compacted material 114 anisotropic in the radial direction at the same time of forming the compacted material 114 into a hollow cylindrical magnet material.

However, in the aforementioned extruding method, magnetic properties at the upper end portion of the cylindrical magnet material shown with symbol A in FIG. 4B are not so good as compared with, for example, a portion shown with symbol B in this figure, and there is a problem since it is not possible to use the upper end portion A practically.

SUMMARY OF THE INVENTION

This invention is made in order to solve the aforementioned problem of the prior art, and the construction of the method for producing an anisotropic rare earth magnet is characterized by comprising charging a compacted material of a rare earth magnet into cylindrical die of a mold, pressing the compacted material with a punch and plastically deforming the compacted material into a magnet material having magnetic anisotropy and a ring-shaped section by extruding the compacted material into a molding cavity formed between the punch and the cylindrical die of the mold, and the compacted material being made its center part to be in contact with an end face of the punch higher than its outer peripheral part to be faced with the molding cavity so as to form difference in level between the center and outer peripheral parts thereof.

The reason why the upper end portion A of the cylindrical magnet material is not so good in the magnetic properties is supposed that the portion A, being a part extruded into the molding cavity 108 at the beginning of the extruding, is extruded in the molding cavity 108 without plastic-deforming sufficiently in the radial direction, so that the degree of deformation at the portion A is low as compared with the other portion of the cylindrical magnet material.

According to this invention, the compacted material of the rare earth magnet is formed in the shape having difference in level between the center part to be in contact with the end face of the punch and the outer peripheral part to be faced with the molding cavity formed between the punch and the cylindrical die of the mold, and extruded. Therefore, it is possible to deform plastically even the portion extruded in the molding cavity at the beginning of the extruding sufficiently.

Accordingly, in a case where the compacted material is extruded into the hollow cylindrical shaped magnet material, it is possible to improve the magnetic properties at the end portion of the cylindrical magnet material, and it is possible to increase yield rate of the expensive rare earth magnet since the end portion also can be used similarly to the other portion of the cylindrical magnet material.

DESCRIPTION OF THE PREFERRED EMBODIMENT

Figure 1C:
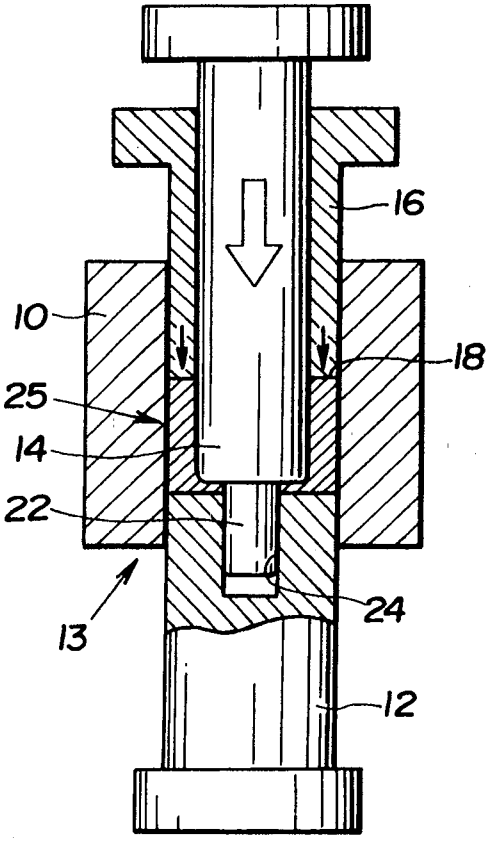
FIGS. 1A, 1B and 1C are sectional views illustrating the extruding method of the compacted material in an embodiment of the method for producing the rare earth magnet according to this invention.

An embodiment of the method according to this invention will be described below on basis of FIG. 1 to FIG. 2.

FIG. 1 shows an example of a case where the compacted material of the rare earth magnet is extruded backwardly, numeral 10 in the drawing denotes a cylindrical die and numeral 12 denotes a bottom die disposed detachably in the bottom part of the cylindrical die 10. Numeral 14 is a core punch, and numeral 16 is a sleeve punch disposed in a molding cavity 18 formed between the core punch 14 and the cylindrical die 10 so as to move backwardly according as extruding of the compacted material. A mold 13 is constructed from the cylindrical die 10, the bottom die 12, the core punch 14 and the sleeve punch 16.

Additionally, the core punch 14 is provided with a slender part 22 downward in the drawing, and the bottom die 12 is formed with a hollow part 24 in a position corresponding to the slender part 22.

Figure 1B:
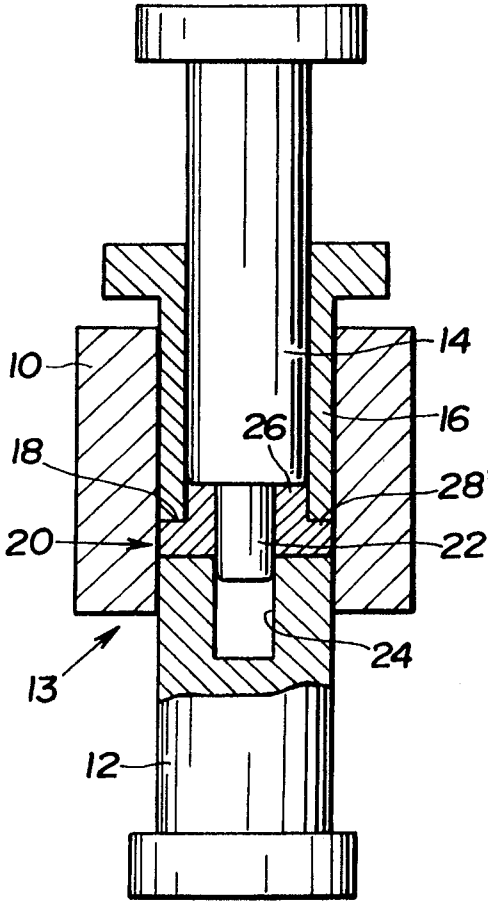
Figure 1A:
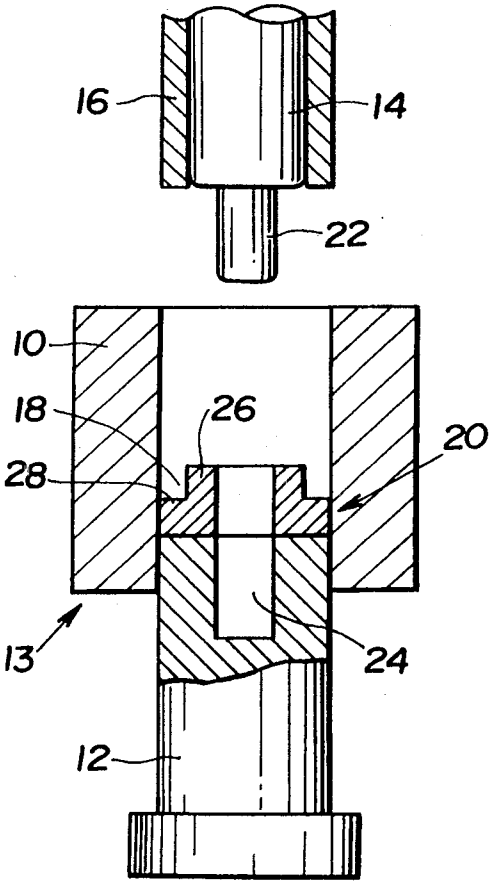

In the method according to this embodiment, first of all, a compacted material 20 of the rare earth magnet is charged in the cylindrical die 10 of the mold 13 as shown FIG. 1A, and the compacted material 20 is heated at a predetermined temperature together with the mold 13. The mold 13 and the compacted material 20 are so designed as to be housed in a closed chamber, and the extruding of the compacted material 20 will be carried out in a nonoxidative atmosphere by evacuating the closed chamber lower than 1 Torr or replacing the atmosphere of the closed chamber with inactive gases such as argon.

The compacted material 20 is formed in a hollow circular plate-like shape as a whole, and made the inner peripheral part 26 higher than the outer peripheral part 28 by projecting the center portion in the axial direction.

Namely, the compacted material 20 is formed with difference in level between a part to be in contact with a pressing face at the end of the core punch 14 and a part to be faced with the molding cavity 18.

After charging the compacted material 20 in the mold 13, the core punch 14 and the sleeve punch 16 disposed coaxially are inserted in the cylindrical die 10 as shown in FIG. 1B, and the end faces of the core punch 14 and the sleeve punch 16 are made in contact with the inner peripheral part 26 and the outer peripheral part 28 of the compacted material 20, respectively.

In this state, the compacted material 20 is deformed plastically and extruded backwardly by pressing the core punch 14 in the downward direction as shown in FIG. 1C, thereby obtaining a cylindrical extrusion 25 (magnetic material).

In this time, the sleeve punch 16 compresses downwardly a free surface of the compacted material 20 extruded into the molding cavity 18 of the mold 13 and goes back according as proceeding of the extruding of the compacted material 20.

By performing the extruding as compressing the free surface of the compacted material 20 with the sleeve punch 16 in this manner, it is possible to prevent effectively the extrusion 25 from cracks.

The extrusion 25 extruded from the compacted material 20 as shown in FIG. 1C is taken out from the mold 13 by moving the bottom die 12 relatively from the cylindrical die 10, and magnetized in the radial direction according to well-known procedures. Whereby the cylindrical extrusion 25 becomes to a rare earth magnet with radial anisotropy.

In the case where the backward extruding of the compacted material 20 is performed through the method according to this embodiment, it is possible to deform plastically even the upper end portion of the cylindrical extrusion 25, that is the portion extruded into the molding cavity 18 at the beginning of the extruding, in the radial direction sufficiently, therefore excellent magnetic properties can be given to the aforementioned portion.

By the way, the effect of the form and dimensions of the compacted material 20 on the magnetic properties has been investigated.

Figure 2:
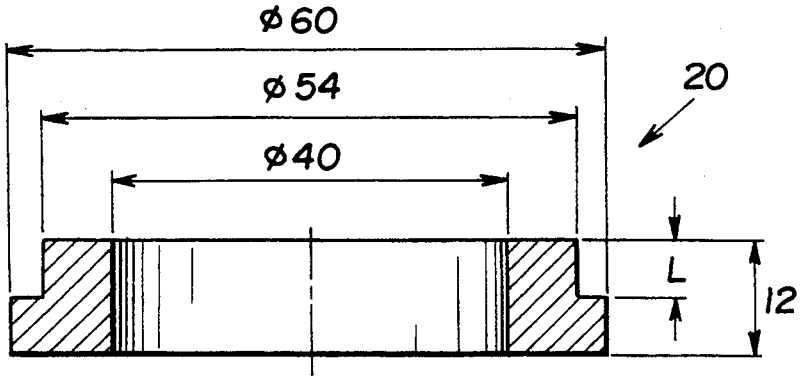
FIG. 2 is a sectional view illustrating a shape of the compacted material of the rare earth magnet used in the embodiment of the method according to this invention.

Namely, using powder of alloy consisting of 28 wt % of Nd, 2.5 wt % of Dy, 0.9 wt % B, 5 wt % of Co, and balancing Fe as powder of magnetic material, five compacted materials 20 differing each other in their dimensions L as shown in FIG. 2 were made by compacting the powder in argon atmosphere at 800° C. Subsequently, each of the compacted materials 20 was extruded into the cylindrical extrusion 25 through the method shown in FIGS. 1A to 1C, and the cylindrical shaped anisotropic rare earth magnet was obtained by magnetizing the extrusion 25.

The results of measurement of the magnetic properties of the obtained anisotropic rare earth magnet were shown in Table 1. The measured values in Table denote the magnetic properties in the radial direction at the portion of upper 5 mm length of the obtained cylindrical rare earth magnet.

TABLE 1

| L(mm) | Br(KG) | iHc(KOe) | (BH)max(MGOe) |
|---|---|---|---|
| 0 | 9.2 | 17.3 | 17.0 |
| 2 | 10.3 | 16.7 | 24.2 |
| 4 | 11.2 | 16.1 | 30.1 |
| 6 | 11.5 | 15.8 | 31.8 |
| 8 | 11.6 | 15.8 | 32.1 |

From the experimental results shown in Table 1, it is clear that it is possible to give excellent magnetic properties even to the portion extruded into the molding cavity 18 at the beginning of the extruding if the extruding is carried out using the compacted material 20 formed in a shape having the protruding inner peripheral part 26, and it is effective to improve the magnetic properties when the protruding height L of the inner peripheral part 26 of the compacted material 20 is not less than 4 mm.

Figure 3:
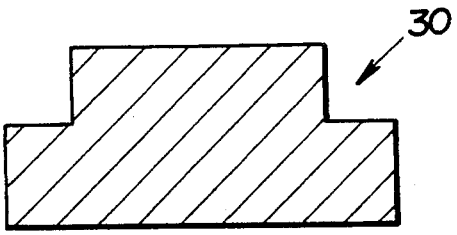
FIG. 3 is a sectional view illustrating a shape of the compacted material used in another embodiment of the method according to this invention.
Figure 4A:
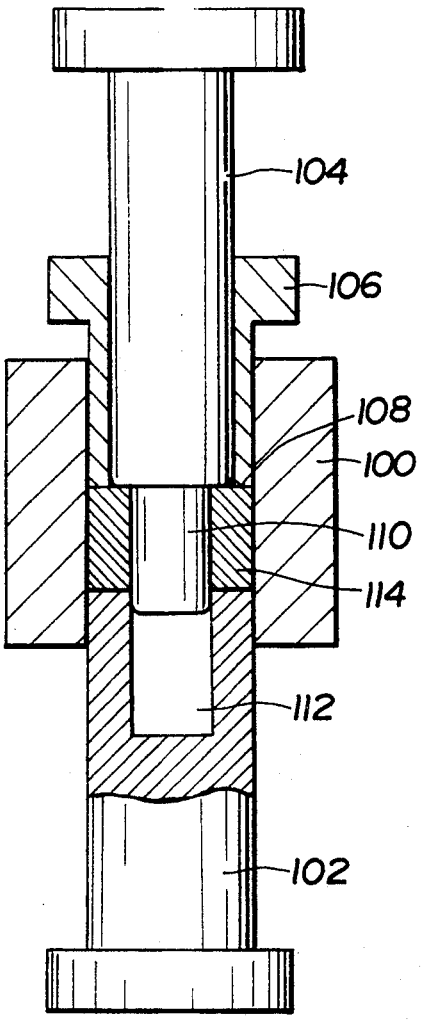
FIGS. 4A and 4B are sectional views illustrating the conventional extruding method of the compacted material.
Figure 4B:
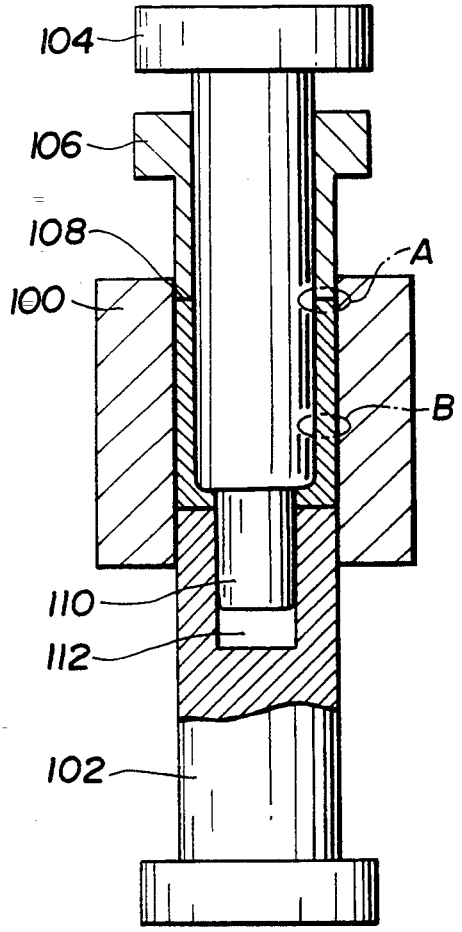

Although the invention has been described in its preferred embodiment, it is merely an example. This invention may be embodied in several forms modified according to knowledge of those skilled in the art without departing from the object of this invention. For example, a solid compacted material 30 as shown in FIG. 3 may be used as a substitute for the hollow-shaped compacted material 20 used in the aforementioned embodiment of this invention, furthermore the method according to this invention may be also applied to a case in which the compacted material is formed into the extrusion by forward extruding.

What is claimed is:

1. A method for producing an anisotropic rare earth magnet, which comprises charging a compacted material of a rare earth magnet into a cylindrical die of a mold and plastically deforming the compacted material into a magnet material having magnetic anisotropy and a ring-shaped section by pressing and extruding said compacted material into a molding cavity formed between a punch and the cylindrical die of the mold, wherein said compacted material has a center part to be contacted by and end face of the punch higher than an outer peripheral part facing said molding cavity so as to be formed with difference in height between said center and outer peripheral parts of the compacted material.

2. A method for producing an anisotropic rare earth magnet as set forth in claim 1, further comprising simultaneously applying compressive force on a free surface of the material extruded into the molding cavity.

3. A method for an anisotropic rare earth magnet as set forth in claim 1, wherein said compacted material is formed in a hollow and circular plate-like shape.

4. A method for producing an anisotropic rare earth magnet as set forth in claim 2, wherein said compacted material is formed in a hollow and circular plate-like shape.

* * * * *